US009656156B2

(12) United States Patent
Gratton et al.

(10) Patent No.: US 9,656,156 B2
(45) Date of Patent: May 23, 2017

(54) MULTI-GAME LOTTERY TICKET ASSEMBLY AND ASSOCIATED METHOD FOR MAKING

(71) Applicant: Scientific Games International, Inc., Newark, DE (US)

(72) Inventors: Stéphane Gratton, Beloeil (CA); Mario Ebacher, Boucherville (CA); Valérie Latreille, Carignan (CA); Gino Boucher, Épiphanie (CA); Marc Bédard, Repentigny (CA); Claudia Lebrun, Montréal (CA)

(73) Assignee: Scientific Games International, Inc., Newark, DE (US)

( * ) Notice: Subject to any disclaimer, the term of this patent is extended or adjusted under 35 U.S.C. 154(b) by 1 day.

(21) Appl. No.: 14/723,606

(22) Filed: May 28, 2015

(65) Prior Publication Data

US 2016/0346675 A1 Dec. 1, 2016

(51) Int. Cl.
*B42D 25/27* (2014.01)
*A63F 3/06* (2006.01)

(52) U.S. Cl.
CPC ..... *A63F 3/0695* (2013.01); *A63F 3/065* (2013.01); *A63F 3/0605* (2013.01); *A63F 3/0655* (2013.01); *A63F 3/0665* (2013.01); *B42D 25/27* (2014.10); *A63F 3/069* (2013.01)

(58) Field of Classification Search
CPC ..... B42D 25/27; A63F 3/0665; A63F 3/0655; Y10S 283/903
USPC ..... 283/103, 105, 106, 901, 903; 428/43
See application file for complete search history.

(56) References Cited

U.S. PATENT DOCUMENTS 5,125,689 A * 6/1992 Heninger ..... A63F 3/069 283/103
5,253,899 A 10/1993 Greenwood
5,562,284 A 10/1996 Stevens
5,618,112 A 4/1997 Lovell
6,145,885 A 11/2000 Scrymgeour et al.
(Continued)

FOREIGN PATENT DOCUMENTS

CA WO 2004082784 A1 * 9/2004 ..... A63F 3/0655
CN 201357 624 12/2008
GB 2 488 910 9/2012

OTHER PUBLICATIONS

International Search Report, Aug. 24, 2016.

*Primary Examiner* — Kyle Grabowski
(74) *Attorney, Agent, or Firm* — Dority & Manning, P.A.

(57) ABSTRACT

A multi-game ticket assembly includes a single continuous substrate having a middle section and opposite end sections folded inwardly against the middle section. A portion of the front surface of each end section is adhered to the front surface of the middle section. Each of the end sections has a game area defined by lines of weakness in the substrate, with each game area further including a first game printed on the rear surface thereof and a second separate game printed on the front surface thereof. The first games of the end sections are adjacent and accessible to a player from a front aspect of the ticket assembly, and the second game of each end section is accessible to the player by separating the game area from its respective end section and folding the game area outwardly away from the middle section.

11 Claims, 4 Drawing Sheets

(56) References Cited

U.S. PATENT DOCUMENTS

| | | | | |
|---|---|---|---|---|
| 7,922,177 | B2 * | 4/2011 | Payne | A63F 3/0605 273/139 |
| 2003/0218331 | A1 | 11/2003 | Yesser | |
| 2005/0127602 | A1 * | 6/2005 | Scrymgeour | B65D 81/38 283/903 |
| 2005/0127662 | A1 * | 6/2005 | Friesen | A63F 3/065 283/49 |
| 2008/0217906 | A1 | 9/2008 | Ellis | |
| 2009/0022926 | A1 * | 1/2009 | Dangami | B42D 15/0053 428/43 |
| 2012/0228861 | A1 * | 9/2012 | Friesen | A63F 3/0665 283/101 |

* cited by examiner

MULTI-GAME LOTTERY TICKET ASSEMBLY AND ASSOCIATED METHOD FOR MAKING

FIELD OF THE INVENTION

The present invention relates generally to the field of game tickets, such as lottery game tickets, and more particularly to a ticket assembly that contains multiple individual game tickets.

BACKGROUND

Various types of game tickets (including lottery tickets) are well known. One of the more common types of game tickets are "instant-win" tickets wherein one or more game plays are printed onto a front surface of a card stock. The player scratches off an opaque layer in a game play area of the ticket to reveal underlying indicia that dictates whether or not the ticket is a winner. Such game tickets are also referred to as "scratch-off" tickets.

Attempts have been made in the industry to bundle or combine multiple instant-win tickets into a single package that is sold to the player. For example, U.S. Pat. No. 6,145,885 describes a lottery ticket construction wherein the rear surface of a first continuous substrate in strip form is adhered to the rear surface of a second continuous substrate in strip form to form a row of connected tickets with a line of weakness between each ticket. Game play indicia for each ticket is printed onto the rear surface of the first strip and is accessible via pull-tab windows defined in the second strip. The combined strips are fan-folded along the lines of weakness.

In a different multi-game ticket configuration, a plurality of individual tickets are joined at an edge to form a "book" of tickets. For example, the Iowa State Lottery offers a "Game Book" containing six separate pages with eight separate scratch-off games for a $20 purchase price.

The types of multi-game or multi-ticket constructions discussed above involve the handling and processing of multiple substrates, which can be complicated and expensive.

Therefore, it is highly desirable to develop multi-ticket or multi-game configuration that appeals to consumers yet is cost effective to produce from a single substrate.

SUMMARY OF THE INVENTION

Objects and advantages of the invention will be set forth in part in the following description, or may be obvious from the description, or may be learned through practice of the invention.

In accordance with aspects of the invention, a multi-game ticket assembly is provided in the form of a single continuous substrate having a front surface and a rear surface, as well as a middle section and opposite end sections folded inwardly against the middle section. A portion of the front surface of each folded end section is adhered to the front surface of the middle section. Each of the end sections has a game area defined by lines of weakness, for example perforation lines, in the substrate, wherein each game area has a first game printed on the rear surface thereof and a second separate game printed on the front surface thereof. With this unique configuration, the first games of the respective end sections are adjacent and accessible to a player from a front aspect of the ticket assembly, and the second game of each end section is accessible to the player by separating the game area from its respective end section and folding the game area outwardly away from the middle section to reveal the second game.

In a particular embodiment, the middle section further includes adjacent third and fourth games printed on the front surface thereof, wherein the third and fourth games underlie the separable game areas and are accessible to the player upon separating the game areas from their respective end section and folding the game areas outwardly away from the middle section to reveal the underlying third and fourth games.

The ticket assembly is not limited to any particular type, theme, or rules of play of the individual games. For example, the individual games may be printed on the substrate as separate scratch-off ticket games. Each of these games may have a separate theme and prize structure unrelated to the other games. In other embodiments, the games may have a common or related theme, and the respective prize structures may also be related such that an overall prize associated with the ticket assembly is a function of results in the individual games.

In a certain embodiment, the portion of the front surface of each end section is adhered to the front surface of the middle section along a border region, wherein the game areas are defined within the border region and are unattached to the front surface of the middle region. An edge of the border regions may be adjacent to each other along a centerline of the middle section.

Any manner of game-related indicia may be printed on any remaining surfaces of the ticket assembly. For example, the rear surface of the middle section may include rules of the games, legal notices, graphics, and so forth.

In some embodiments, the ticket assembly is further folded at a center fold line of the middle section such that the first games are facing each other in this folded configuration and are accessible to the player by unfolding the middle section.

The present invention also encompasses various method embodiments for making the multi-game ticket assembly described above. An exemplary method may include defining a middle section and opposite end sections on a single continuous substrate having a front surface and a rear surface. A first game in printed on the rear surface of the substrate in a game area of each of the end sections. On the front surface of the substrate, a second game is printed on the game area of each of the end sections. The method further includes defining the game areas in the end sections by lines of weakness, such as perforation lines, so that the game areas are partially separable from their respective end section along the lines of weakness. The end sections are folded inwardly against the middle section and the front surface of the end sections are partially adhered to the front surface of the middle section. Thus, the ticket assembly is made such that the first games of the end sections are adjacent and accessible to a player from a front aspect of the ticket assembly, and the second game of each end section is accessible to the player by separating the game area from its respective end section and folding the game area outwardly away from the middle section.

A method embodiment may further include printing third and fourth games adjacent to each other on the front surface of the middle section, wherein the third and fourth games underlie the separable game areas and are accessible to the player upon separating the game areas from their respective end section and folding the game areas outwardly away from the middle section.

The method may include printing the various games as scratch-off ticket games.

For adhering the folded end sections to the middle section, the method may include adhering a border region of the front surface of each end section to the front surface of the middle section such that the game areas are defined within the border region of their respective end section and are unattached to the front surface of the middle region. The border regions may be adjacent each other along a centerline of the middle section.

The method may further include folding the middle section along a center fold line (e.g., the centerline of the middle section) such that the first games are facing each other in a folded configuration of the middle section and are accessible to the player by unfolding the middle section.

DETAILED DESCRIPTION

Reference will now be made in detail to examples of the present invention, one or more embodiments of which are illustrated in the figures. Each example is provided by way of explanation of the invention, and not as a limitation of the invention. For instance, features illustrated or described with respect to one embodiment may be used with another embodiment to yield still a further embodiment. It is intended that the present application encompass these and other modifications and variations as come within the scope and spirit of the invention.

Figure 1:
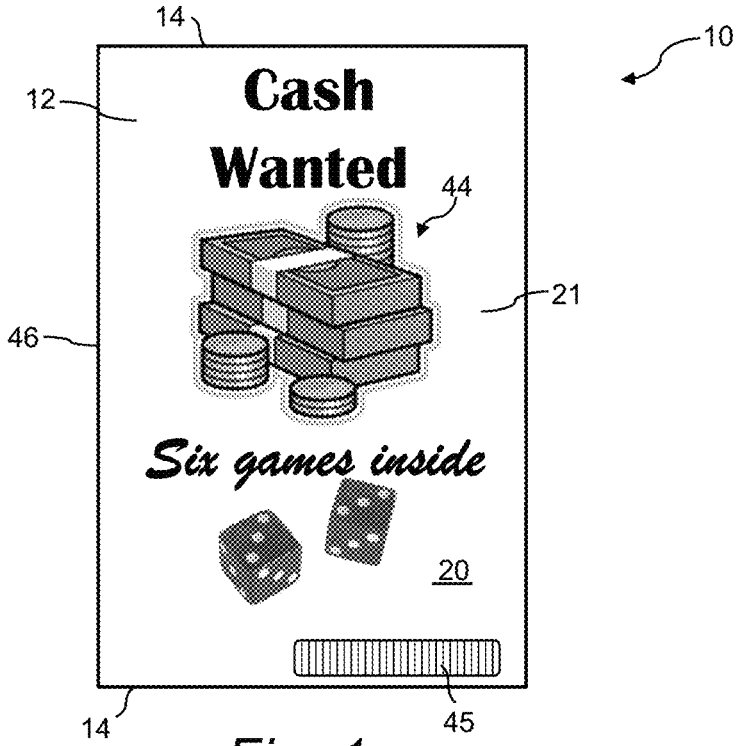
FIG. 1 is a front aspect view of a folded multi-game ticket assembly in accordance with aspects of the invention.

Referring to FIGS. 1 through 5 in general, a multi-game ticket assembly 10 is illustrated. The ticket assembly 10 is formed from a single continuous substrate 12, such as a continuous strip of card stock or paper board substrate. It should be appreciated that the invention is not limited by the materials used to form the substrate 12. The substrate 12 includes a front surface 18 and a rear surface 20 in an initial state of the substrate 12 depicted in FIG. 6. The substrate 12 includes side edges 14 and end edges 16. FIG. 1 depicts the ticket assembly 10 in a final folded configuration as the ticket assembly 10 would be presented to a purchaser, wherein the ticket assembly 10 includes a front face 21 having any manner of game-related indicia 44 that may include graphics and wording to describe the games contained therein. It should be appreciated that the ticket assembly 10 is not limited by any particular type or manner of game-related indicia 44, or the method of printing such indicia 44 thereon. Still referring to FIG. 1, the game ticket assembly 10 may include a barcode 45 or other type of machine-readable code that may serve any number of functions known to those skilled in the art, such as ticket serial number, verification, redemption, security functions, and the like.

Figure 2:
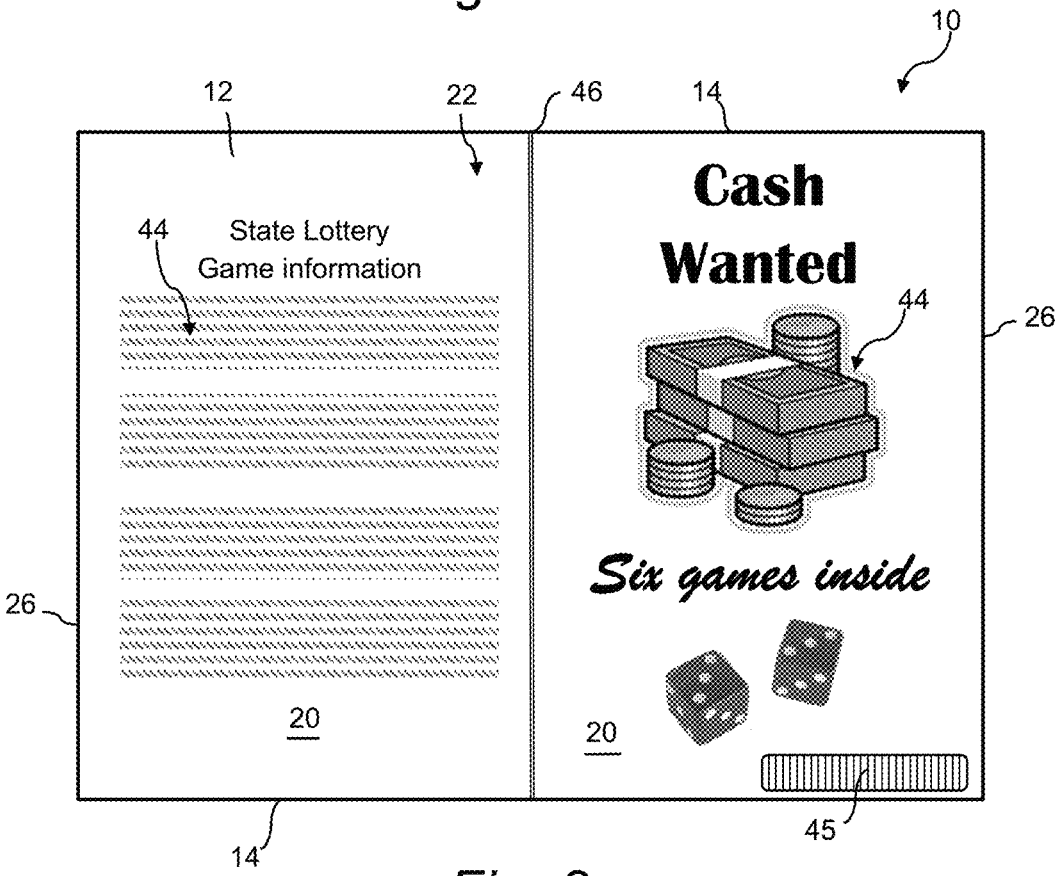
FIG. 2 is a back or rear aspect view of the ticket assembly of FIG. 1 in an unfolded configuration.

FIG. 2 depicts the ticket assembly 10 of FIG. 1 in an unfolded state wherein the two halves of the ticket assembly 10 are unfolded at a fold line 46 that defines the left-hand edge of the folded ticket assembly 10 depicted in FIG. 1. FIG. 2 depicts portions of the back surface 20 of the substrate 12, wherein the right-hand portion of the back surface 20 defines the front face 21 depicted in FIG. 1, and the left-hand portion of the back surface 20 defines a back face of the ticket assembly 10 in the folded configuration of FIG. 1.

Figure 3:
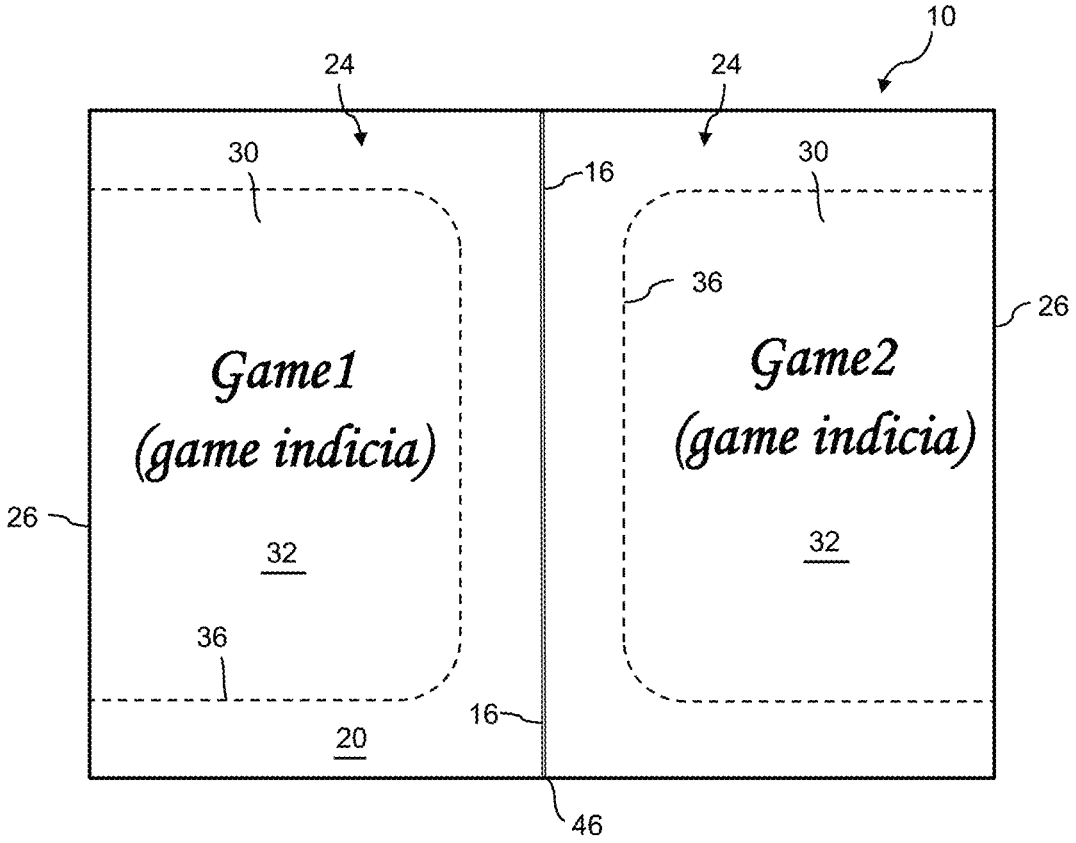
FIG. 3 is a front aspect view of the ticket assembly of FIG. 2.
Figure 4:
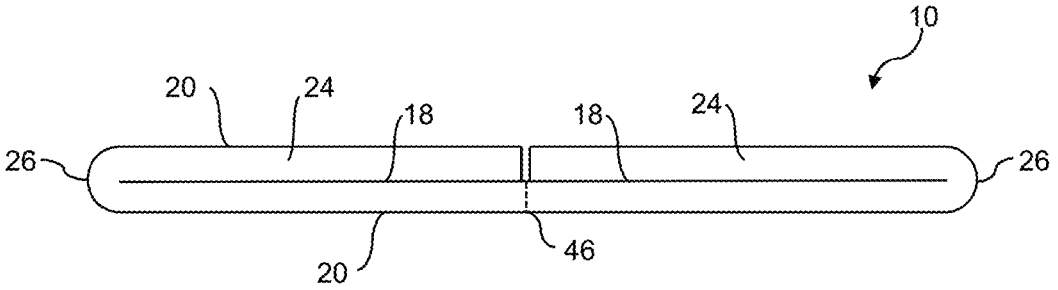
FIG. 4 is an end view of the ticket assembly of FIG. 3.
Figure 6:
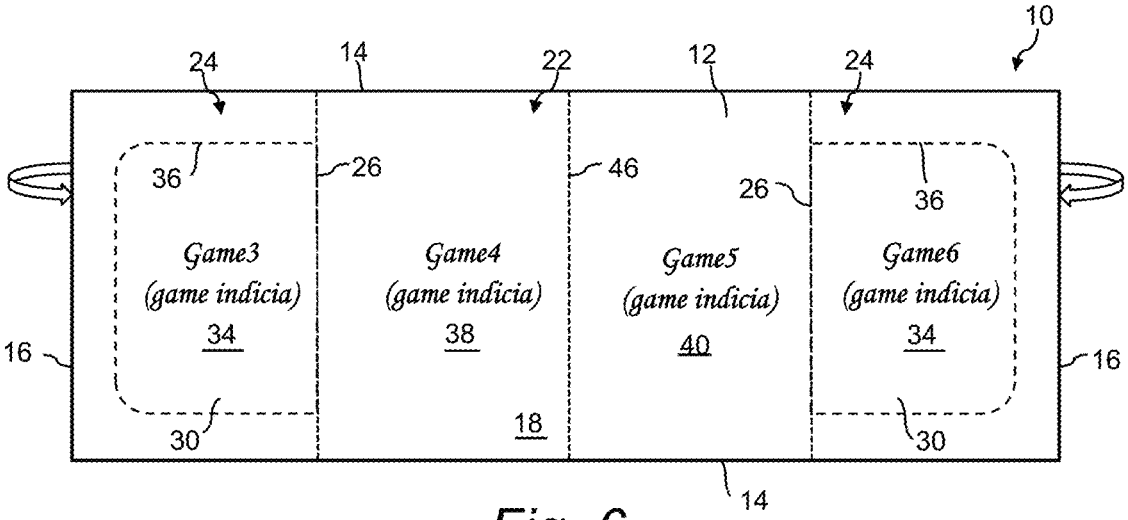
FIG. 6 is a front view of the single continuous substrate of the ticket assembly prior to folding and attaching of the ends sections against the middle section.
Figure 7:
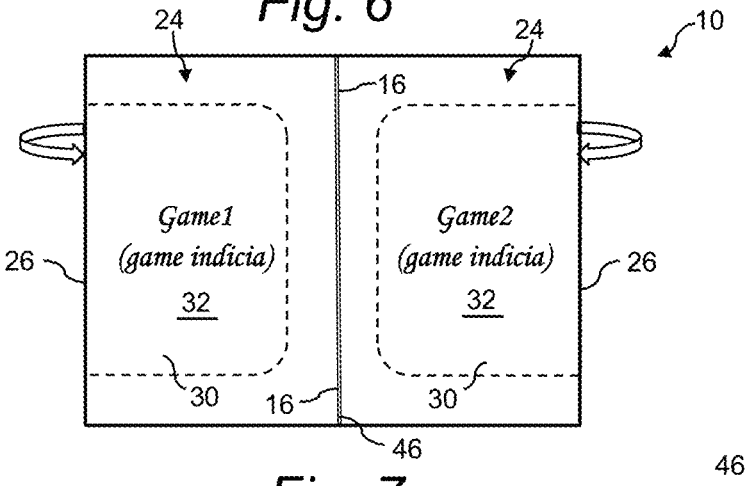
FIG. 7 is a front view of the substrate of FIG. 6 after folding of the end sections inwardly against the middle section.

Referring to FIG. 6, the continuous substrate 12 is illustrated in an initial state and depicts the front surface 18 thereof. The substrate 12 includes a middle section 22 and opposite end sections 24. Fold lines 26 are identified between the end sections 24 and the middle section 22. A center fold line 46 is identified in the middle section 22, which may correspond to the centerline of the middle section 22. Referring to FIGS. 3, 4, and 7 in particular, the opposite end sections 24 are folded inwardly along the fold lines 26 so as to lie against the middle section 22, as can be particularly seen in FIG. 4. A portion of the front surface 18 of the end sections 30 is adhered to the front surface of the middle section 22. The folds may be defined such that the ends 16 of the continuous substrate 12 meet at the center fold line 46 of the middle section 22, as particularly seen in FIGS. 4 and 7.

Each of the end sections 24 includes a game area 30 defined by lines of weakness 36 in the substrate. These lines of weakness 36 may be defined by any conventional means, such as perforation lines, laser-etched lines, and the like. Each game area 30 includes a first game 32 printed on the rear surface 20 of the substrate such that these first games 32 are presented to the player upon unfolding the ticket assembly 10 at the center fold line 46 of the middle section, as depicted in FIGS. 3, 4, and 7.

Figure 5:
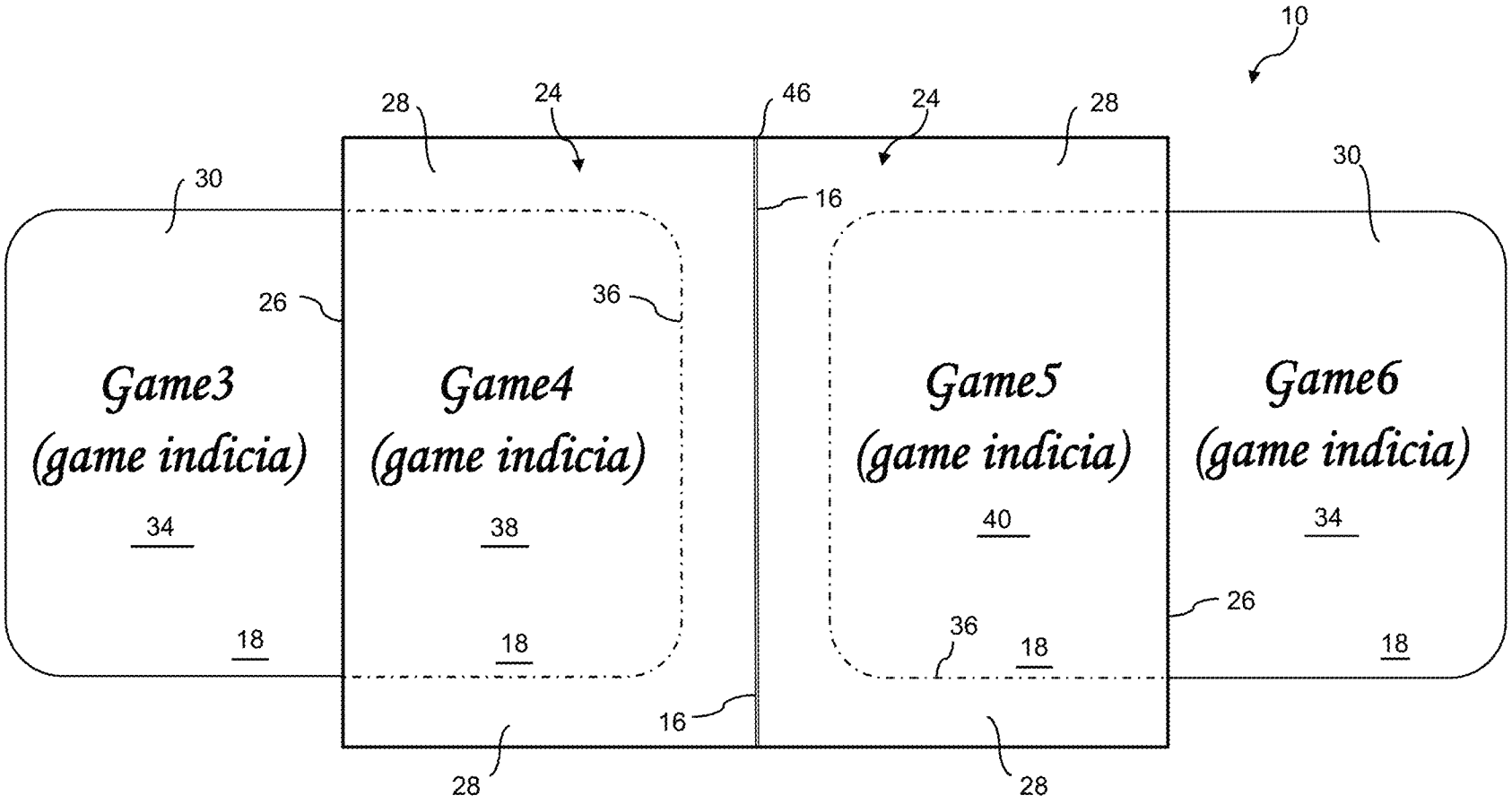
FIG. 5 is a front aspect view of the ticket assembly of FIG. 3 with the game areas of the opposite end sections separated from the ends sections along lines of weakness.

Referring to FIGS. 5 and 6, each of the game areas 30 also includes a second game 34 printed on the front surface 18 of the substrate, as particularly illustrated in FIG. 6. These second games 34 are initially not presented to the player in the configuration of FIG. 3, but become accessible to the player upon separating the game areas 30 along the lines of weakness 36 and unfolding the game areas 30 outwardly away from the middle section 22 along the fold lines 26, as depicted in FIG. 5.

Thus, referring to FIGS. 3 and 5, initially the player is presented with the first games 32 upon unfolding the ticket assembly 10 of FIG. 1 along the fold line 46. The player has the option to play these first games 32 before revealing any of the other games within the ticket assembly 10, or may proceed to gain access to the other games without playing the first games 32. Referring to FIG. 5, access to the other games is obtained by partially separating the game areas 30 along the respective lines of weakness 36 so that the game areas 30 are folded outwardly to reveal the second games 34 printed on the back surface of the end sections 24.

Referring to FIGS. 5 and 6, the substrate 12 may include third and fourth games 38, 40 printed on the front surface 18 of the substrate 12. These games 38, 40 become accessible to the player upon folding the game areas 30 outwardly away from the middle section 22 of the ticket assembly 10 to reveal the underlying front surface 18 of the substrate 12, as depicted in FIG. 5. Thus, with this unique configuration, the player is presented with a total of six separate games in the ticket assembly 10.

Referring to FIGS. 3 and 5 in particular, the portion of the front surface 18 of each end section 24 that is adhered to the front surface 18 of the middle section 22 may be defined as a border region 28 that essentially surrounds and defines the game areas 30. In other words, the portion of the end sections 24 not adhered to the front surface 18 of the middle section 22 is the respective game area 30, as depicted particularly in FIG. 5.

Referring to FIGS. 1 and 3, it should be appreciated that, in the folded configuration of the ticket assembly 10 depicted in FIG. 1, the first games 32 face each other and only become accessible upon the player unfolding the middle section along the fold line 46, as depicted in FIG. 3.

Referring to FIG. 2, the left-hand portion of the middle section 22 depicted in the figure contains any manner of game-related indicia 44 that may describe the rules of the game, restrictions, legal notices, and so forth. Any manner of game-related indicia 44 may be printed on this surface as required by a particular lottery jurisdiction, and the like.

As mentioned above, the individual games 32, 34, 38, and 40 are not limited to any particular type, theme, or rules of play. In the illustrated embodiment, the individual games may be printed on the continuous substrate 12 as separate scratch-off ticket games wherein a plurality of game pieces are covered by an opaque scratch-off layer, as is well known to those skilled in the art. Each of these games may have a separate theme and prize structure unrelated to the other games or, in an alternate embodiment, may have a common or related theme. The respective prize structures may also be related such that an overall prize associated with the ticket assembly is a function of results in the individual games, and not merely a cumulative total of the prizes in the individual games. For example, a cumulative prize total in the individual games may result in a bonus prize, and so forth.

As mentioned above, and generally depicted in FIGS. 6 through 8, the present invention also encompasses various method embodiments for making the multi-game ticket assembly 10 described above. One such method embodiment is depicted in FIGS. 6 through 8 and includes defining a middle section 22 and opposite end sections 24 on a single continuous substrate 12, the substrate 12 having a front surface 18 and a rear surface 20, as well as sides 14 and end edges 16.

The method includes printing a first game on the rear surface 20 of the substrate 12 in a defined game area 30 of each of the end sections 24. The game area 30 is defined so as to be at least partially separable from the end section 24 along lines of weakness 36, such as perforation lines. The first games 32 printed on the rear surface 20 of the substrate are visible in FIG. 7 after the end sections 24 are folded inwardly towards the middle section 22, as depicted by the arrows in FIG. 6. The fold lines 26, may be defined such that the end edges 16 of the substrate 12 generally meet at a centerline or center fold line 46 of the middle section 22, as depicted in FIG. 7.

Upon folding the end sections 24 inwardly and against the middle section 22, such end sections 24 are partially adhered to the front surface 18 of the middle section 22, for example along a border area 28 that defines the game areas 30, as discussed above. Referring to FIG. 6, the method may further include printing third and fourth games 38, 40 adjacent to each other on the front surface 18 of the middle section 22, wherein the games 38 and 40 are separated by the center fold line 46. These games 38, and 40 become accessible to the player upon separating the game areas 30 from their respective end section 24 and folding the game areas 30 outwardly away from the middle section 22, as discussed above with respect to FIG. 5. The adhered border areas 28 of the end sections 24 remain attached to the middle section 22, with the unattached portion of the end section 24 corresponding to the game area 30 defined by the lines of weakness 36.

Figure 8:
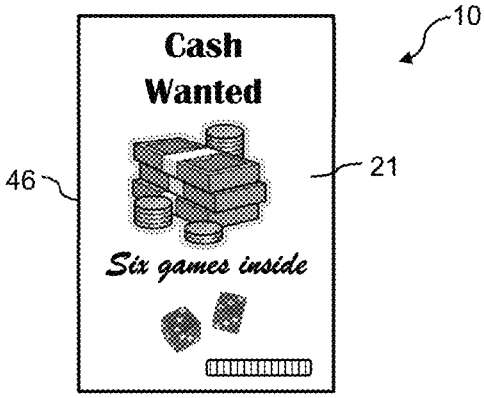
FIG. 8 is a front view of the substrate of FIG. 7 after folding along the centerline of the middle section.

Referring to FIG. 7, the method may further include folding the substrate 12 an additional time as depicted by the arrows in FIG. 7 along the center fold line 46 to make the final configuration of the ticket assembly 10 depicted in FIG. 8 and discussed above with respect to FIG. 1.

It should be readily appreciated that the present invention may incorporate any known and conventional method for printing instant scratch-off lottery tickets onto a substrate. Such tickets may include any feature of conventional scratch-off lottery tickets.

What is claimed is:

1. A multi-game ticket assembly, comprising:

a single continuous substrate comprising a front surface and a rear surface, the substrate further comprising a middle section and opposite end sections folded inwardly against the middle section along fold lines between the middle section and respective end section;

a portion of the front surface of each end section adhered to the front surface of the middle section;

each of the end sections having a game area defined by lines of weakness in the substrate except along the fold line between the end section and the middle section, each game area further comprising a first game printed on the rear surface thereof and a second separate game printed on the front surface thereof;

wherein the first games of the end sections are adjacent and accessible to a player from a front aspect of the ticket assembly, and the second game of each end section is accessible to the player by separating the game area from its respective end section along the lines of weakness and folding the game area outwardly away from the middle section;

wherein the middle section is releasably folded along a center fold line such that the first games are facing each other in a folded configuration of the middle section and are accessible to the player by unfolding the middle section; and wherein the portion of the front surface of each end section is permanently adhered to the front surface of the middle section along a border region, the game areas defined within the border region and unattached to the front surface of the middle region.

2. The multi-game ticket assembly as in claim 1, wherein the middle section further comprises adjacent third and fourth games on the front surface thereof, the third and fourth games underlying the separable game areas and accessible to the player upon separating the game areas from their respective end section and folding the game areas outwardly away from the middle section.

3. The multi-game ticket assembly as in claim 2, wherein the first games, second games, third game, and fourth game are scratch-off ticket games.

4. The multi-game ticket assembly as in claim 2, wherein each of the first games, second games, third game, and fourth game have individual and independent prize structures.

5. The multi-game ticket assembly as in claim 1, wherein the rear surface of the middle section comprises indicia related to play of the games within the ticket assembly.

6. The multi-game ticket assembly as in claim 1 wherein the game areas are defined by perforation lines.

7. A method for making a multi-game ticket assembly, comprising:

on a single continuous substrate having a front surface and a rear surface, defining a middle section and opposite end sections;

on the rear surface of the substrate, printing a first game on a game area of each of the end sections;

on the front surface of the substrate, printing a second game on the game area of each of the end sections;

defining the game areas in the end sections by lines of weakness except along a fold line between the end section and the middle section so that the game areas are only partially separable from their respective end section along the lines of weakness;

folding the end sections inwardly against the middle section and partially adhering the front surface of the end sections to the front surface of the middle section;

releasably folding the middle section along a center fold line such that the first games are facing each other in a folded configuration of the middle section and are accessible to the player by unfolding the middle section;

wherein the first games of the end sections are adjacent and accessible to a player from a front aspect of the ticket assembly by unfolding the middle section, and the second game of each end section is subsequently accessible to the player by separating the game area from its respective end section and folding the game area outwardly away from the middle section; and wherein the portion of the front surface of each end section is permanently adhered to the front surface of the middle section along a border region, the game areas defined within the border region and unattached to the front surface of the middle region.

8. The method as in claim 7, further comprising printing third and fourth games adjacent to each other on the front surface of the middle section, wherein the third and fourth games underlie the separable game areas and are accessible to the player upon separating the game areas from their respective end section and folding the game areas outwardly away from the middle section.

9. The method as in claim 8, wherein the first games, second games, third game, and fourth game are printed as scratch-off ticket games.

10. The method as in claim 7, further comprising printing indicia on the rear surface of the middle section related to play of the games within the ticket assembly.

11. The method as in claim 7, further comprising defining the lines of weakness as perforation lines in the end sections.

* * * * *